US009837723B2

(12) United States Patent
Lee-Bouhours et al.

(10) Patent No.: US 9,837,723 B2
(45) Date of Patent: Dec. 5, 2017

(54) CONFIGURABLE MICROWAVE DEFLECTION SYSTEM

(71) Applicant: THALES, Courbevoie (FR)

(72) Inventors: Mane-Si Laure Lee-Bouhours, Les Molieres (FR); Antoine Brus, Sceaux (FR); Brigitte Loiseaux, Bures-sur-Yvette (FR); Thierry Dousset, Saint-Gratien (FR); Christian Renard, Boulogne Billancourt (FR)

(73) Assignee: THALES, Courbevoie (FR)

( * ) Notice: Subject to any disclaimer, the term of this patent is extended or adjusted under 35 U.S.C. 154(b) by 364 days.

(21) Appl. No.: 14/769,510

(22) PCT Filed: Feb. 10, 2014

(86) PCT No.: PCT/EP2014/052503
§ 371 (c)(1),
(2) Date: Aug. 21, 2015

(87) PCT Pub. No.: WO2014/128015
PCT Pub. Date: Aug. 28, 2014

(65) Prior Publication Data

US 2015/0380829 A1 Dec. 31, 2015

(30) Foreign Application Priority Data

Feb. 22, 2013 (FR) ..... 13 00410

(51) Int. Cl.
*H01Q 15/10* (2006.01)
*H01Q 3/14* (2006.01)

(52) U.S. Cl.
CPC ..... *H01Q 15/10* (2013.01); *H01Q 3/14* (2013.01)

(58) Field of Classification Search
CPC ..... H01Q 3/14; H01Q 15/10
See application file for complete search history.

(56) References Cited

U.S. PATENT DOCUMENTS 4,365,863 A * 12/1982 Broussaud ..... H04Q 3/526 385/17
4,794,398 A 12/1988 Raber et al.
(Continued)

FOREIGN PATENT DOCUMENTS

| | | | |
|---|---|---|---|
| EP | 0 179 687 | A1 | 4/1986 |
| FR | 2 570 886 | A1 | 3/1986 |
| FR | 2 945 674 | A1 | 11/2010 |

*Primary Examiner* — Jessica Han
*Assistant Examiner* — Jae Kim
(74) *Attorney, Agent, or Firm* — Baker & Hostetler LLP

(57) ABSTRACT

A configurable deflection system for an incident microwave frequency beam exhibiting a wavelength contained in a band of wavelengths corresponding to the microwave frequencies, comprising: a first and a second diffractive dielectric component suitable for each performing a rotation about a rotation axis Z, the deflection system being suitable for generating a microwave frequency beam by diffraction of the incident microwave frequency beam on the first and second components, the microwave frequency beam being oriented according to an angle that is a function of the angular positioning between the first and said second diffractive components, the first and second components respectively exhibiting a first and second periodic structure of first and second periods according to a first and second axis, the first and second structures respectively comprising a plurality of first and second primary microstructures formed respectively on a first and second substrate of first and second substrate refractive indices.

19 Claims, 12 Drawing Sheets

(56) References Cited

U.S. PATENT DOCUMENTS

| | | | | |
|---|---|---|---|---|
| 7,538,946 | B2 * | 5/2009 | Smith | B82Y 20/00 359/569 |
| 2013/0076581 | A1 * | 3/2013 | Lee-Bouhours | H01Q 15/08 343/753 |
| 2017/0141464 | A1 * | 5/2017 | Driscoll | H01Q 3/14 |

* cited by examiner

CONFIGURABLE MICROWAVE DEFLECTION SYSTEM

CROSS-REFERENCE TO RELATED APPLICATIONS

This application is a National Stage of International patent application PCT/EP2014/052503, filed on Feb. 10, 2014, which claims priority to foreign French patent application No. FR 1300410, filed on Feb. 22, 2013, the disclosures of which are incorporated by reference in their entirety.

FIELD OF THE INVENTION

The invention relates to the processing of microwave frequency waves, and in particular the deflection of a microwave frequency beam. More specifically, the invention relates to a configurable deflection system.

STATE OF THE ART

The invention applies to the processing of a microwave frequency beam, corresponding to frequencies lying between 300 MHz and 300 GHZ, with typical wavelengths of 1 mm to 1 m.

A number of applications require the capability to control the direction in which the beam is transmitted and/or received. This property is called aiming.

For the aiming, the antenna has to be configured to transmit/receive a wave in a given direction of space. For example, these days, in the field of telecommunications, there is an increasing need to have to redirect an antenna, following the updating of the coverage of the land. For example, each time an antenna is removed, there follows a repositioning of the neighboring antennas. Moreover, the coverage of the land is constantly changing because of the ceaseless search to improve the coverage while optimizing the costs and therefore by minimizing the number of antennas. It also happens that certain antennas have to be eliminated or moved, which gives rise to a reorientation of the neighboring antennas. It is therefore important to have so-called "smart" and "remote" antennas, "smart" for their capacity to be oriented to cover different areas in space and "remote" for their capacity to be controllable remotely from a central facility.

For the tracking, the antenna has to be configured to track a target, such as a satellite.

For the scanning, the beam must illuminate a defined part of the space or scene to analyze it.

Furthermore, efforts are constantly being increased to obtain compact antennas, of reduced weight and bulk.

Different known techniques make it possible to produce an agile antenna.

A first solution is mechanical. The drawbacks are the addition of an extra mechanical system, in weight/volume (relative to the location of a mast), a sphere of significant bulk, as seen from the outside, which changes volume according to its orientation, the reliability (above all if a "remote" antenna is wanted), and the servicing and preventive maintenance costs.

Another type of antennas called "electronic scanning" antennas can be oriented electrically. The antenna is made up of different radiant elements or individual antennas mounted in an array and each with an associated phase shifter. These phase shifters make it possible to inject different phases so as to generate a deflection of the beam.

However, this solution presents the following drawbacks

- a complex system: a phase shifter is needed for each individual antenna and a control is needed for each phase shifter, hence an associated power supply. In addition, there are generally numerous wires per individual phase shifter so there is a need for good management of the cables. To facilitate this cable management, the wires are often incorporated in printed circuits to facilitate the "management" of the cables;
- the phase shifters in certain cases have difficulty supporting the power, hence a power limitation,
- the presence of the phase shifters requires the effects of the power and of the temperature to be taken into account, and therefore requires the addition of a cooling system to extract the energy,
- this technology is costly,
- this technology involves electrical consumption to maintain the control, even when the antenna is not operating.

Another solution is to go back to the principle of optical scanning based on prisms conventionally called "diasporameter". Such a device applied to the microwave frequency waves is described for example in the document FR 2570886. FIG. 1 describes the principle of operation of such a deflector.

An antenna emits a radiation toward two prisms arranged "back to back", rotating relative to one another according to an axis ZZ' at right angles to the transmitting surface, and independently. When a prism passes, the incident radiation is deflected in a given direction, that is a function of the index of the material or of the materials forming the prism and of its angle at the vertex. The total deflection angle θ imparted by the assembly of the two prisms depends on the angles of rotation of the two prisms. A drawback of this system for its application to microwave frequencies is the bulk of the deflector resulting from the thickness of the prisms.

The document FR 2945674 discloses the use of disks of constant thickness, of refractive index increasing linearly from one end to the other end of the disk to obtain the deflection of the electromagnetic wave passing through the disk. This solution makes it possible to have two planar-faced components and therefore avoid effects of unbalance. However, from a bulk point of view, this solution offers a bulk linked to the thickness similar to that of a solid prism for an equivalent deflection. Furthermore, as with solid prisms, the greater the diameter (or aperture) of the deflection system, the greater the diameter of the components, which leads to an increase in their thickness (given the same material) to obtain the desired deviation, resulting in a component that is all the more bulky.

The document FR 2570886 describes also the use of structures on the faces of the prisms, to produce an adaptation layer providing an antiglare function.

The documents FR 2570886 and FR 2945674 describe also the possibility of replacing the prism by a blazed diffraction grating, called "zoned prism". The thickness of the prism is reduced by the creation of zones for which the differential phase shifting between the material forming the prism, a dielectric material with high refractive index (greater than the index of the air), and the air is equal to 2π between each zone. The height h of the blazed grating is given by the formula:

$$h=\lambda 0/(n-1)$$

with λ0 being the design wavelength of the device, typically equal to the wavelength of the incident microwave frequency beam and n being the index of the material.

By way of example, a blazed grating produced in Rexolite material of index 1.59 has a height h of approximately 17 mm for $\lambda 0$=10 mm.

The period P of the grating determines the angle by which the diffraction of the grating is applied. For an incident beam Finc in normal incidence on a blazed grating of period P, the diffraction angle θp that the first order diffracted beam, called main diffracted beam F0, forms with the normal to the grating, is determined by the law of gratings well known for a grating illuminated with normal incidence from the air:

$$\sin \theta p = \lambda 0 / P$$

Typically, with $\lambda 0$=10 mm for a deviation of 30°, it is sufficient to adjust the period of the grating to P=20 mm.

The component thus has a smaller bulk than the prism. In addition, the thickness of the component no longer depends on the size of the system (diameter or aperture of the system), which is a major advantage when the aperture of the system is great.

The diffraction effectiveness or diffraction efficiency η of the grating is defined by the formula:

$$\eta = I0 / Ii$$

Ii and I0 corresponding respectively to the intensity of the incident beam Finc and of the main diffracted beam F0.

In terms of diffraction effectiveness, this solution is suitable when the total deviation angle is less than approximately 10°, or an angle of 5° per grating. However, when a strong deviation is required, for example at least equal to +/−20°, this solution is no longer suitable because it induces losses that increase with the angle of diffraction, because of the shadowing effect. The shadow or masking effect is illustrated in FIG. 2 by a ray plot. The part of the incident beam Finc corresponding to the zone 21 is not diffracted in the direction θp of the main diffracted beam F0, and a part 22 of the diffracted beam is lost, inducing a loss.

Furthermore, when the angle of the first order diffracted beam increases, which corresponds to a period P of the grating which decreases, the energy diffracted in the other orders of the grating or secondary orders increases, also inducing a loss on the diffraction effectiveness of the grating, and therefore on the intensity of the deflected microwave frequency beam.

OBJECT OF THE INVENTION

The object of the invention is to remedy the abovementioned drawbacks, by proposing a compact and lightweight deflection system that makes it possible to obtain high deflection angles, a high effectiveness on the main order of diffraction corresponding to the main direction of the deflection, and a strong attenuation of the other orders of diffraction.

DESCRIPTION OF THE INVENTION

There is proposed, according to one aspect of the invention, a configurable deflection system for an incident microwave frequency beam exhibiting a wavelength contained in a band of wavelengths corresponding to the microwave frequencies, comprising:

a first and a second diffractive dielectric component suitable for each performing a rotation about a rotation axis Z, the deflection system being suitable for generating a microwave frequency beam by diffraction of the incident microwave frequency beam on the first and second components, the microwave frequency beam being oriented according to an angle that is a function of the angular positioning between the first and the second diffractive components, the first and second components respectively exhibiting a first and second periodic structure of first and second periods according to a first and second axis, the first and second structures respectively comprising a plurality of first and second primary microstructures formed respectively on a first and a second substrate of first and second substrate refractive indices, the first and second primary microstructures respectively exhibiting at least one first and one second primary size smaller than the ratio between a target wavelength chosen from the band and respectively the first and second substrate refractive indices, the first and second primary microstructures being arranged so as to form an artificial material respectively exhibiting a first variation of a first respective refractive index and a second variation of a second effective refractive index respectively according to said first and second periods.

Advantageously, the primary microstructures are formed in the body of the first and second substrates.

Advantageously, the first primary microstructures are in the form of a pillar and/or a hole.

Advantageously, the second primary microstructures are in the form of a pillar and/or a hole.

Advantageously, the primary microstructures exhibit a hexagonal, circular or square section.

According to one embodiment, at least one of the periods is sampled according to a sampling period defining sampling intervals, the primary microstructures being arranged within each interval so as to correspond to a given effective index value in the interval.

According to one embodiment, the first and/or second primary microstructures respectively exhibit a plurality of first and/or second primary sizes variable along respectively the first period and/or the second period.

Advantageously, at most one primary microstructure is arranged per sampling interval.

According to one embodiment, the first and/or second primary microstructures respectively exhibit a first and/or a second given main size and a density per unit of surface area variable respectively along the first and the second periods.

According to one embodiment, the system according to the invention further comprises at least one plurality of secondary microstructures of secondary sizes smaller than the primary sizes.

Advantageously, at most one secondary microstructure is arranged per sampling interval.

Advantageously, the first component and/or the second component is at right angles to the rotation axis Z.

Advantageously, the first period is less than or equal to the second period.

Advantageously, the incident beam is a collimated beam.

According to one embodiment, the microwave frequency beam generated comprises a deflected main beam of relative gain of the main lobe and a plurality of spurious diffracted beams of relative gains of the spurious lobes, and the first and second variations respectively of the first and second effective indices are adapted so that each of the deviations between the relative gain of the main lobe and one of the relative gains of the spurious lobes is greater than or equal to 10 dB when the incident microwave frequency beam exhibits a wavelength equal to said target wavelength.

There is also proposed, according to another aspect of the invention, an antenna comprising a microwave frequency source arranged substantially at the focus of a dielectric lens so as to generate a collimated beam and a deflection system according to one of the aspects of the invention.

Advantageously, the dielectric lens is produced from microstructures exhibiting a size smaller than the ratio between a target wavelength chosen from the band and respectively the first and second substrate refractive indices.

Advantageously, the dielectric lens is produced on a face of the first component opposite the microwave frequency source, the first structure of the first component being produced on the other face.

According to one embodiment, the antenna according to the invention comprises a microwave frequency waveguide suitable for generating a collimated bean and a deflection system according to one of the aspects of the invention.

BRIEF DESCRIPTION OF THE DRAWINGS

Other features, objects and advantages of the present invention will become apparent on reading the following detailed description and in light of the attached drawings given as nonlimiting examples and in which.

DETAILED DESCRIPTION OF THE INVENTION

Figure 1:
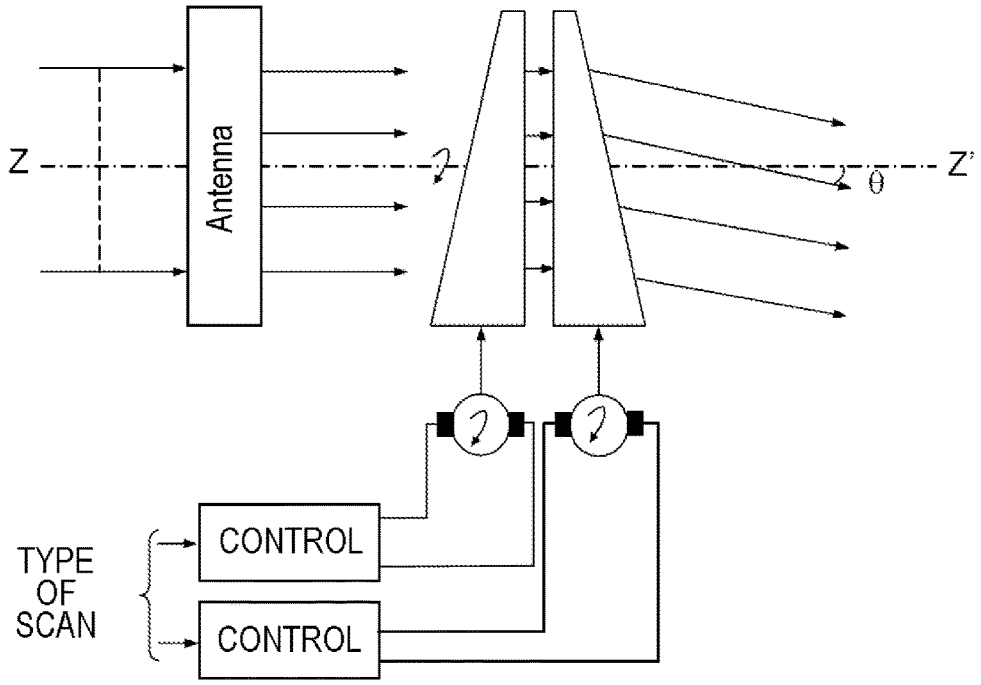
FIG. 1, already cited, illustrates the principle of the diasporameter applied to a microwave frequency wave.
Figure 2:
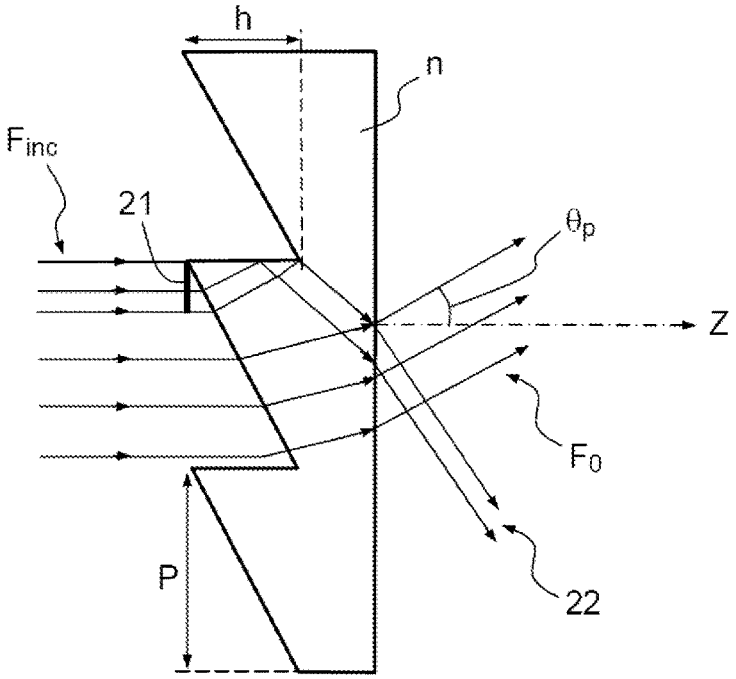
FIG. 2, already cited, illustrates the shadowing effect induced by a blazed grating with strong diffraction angles.
Figure 3:
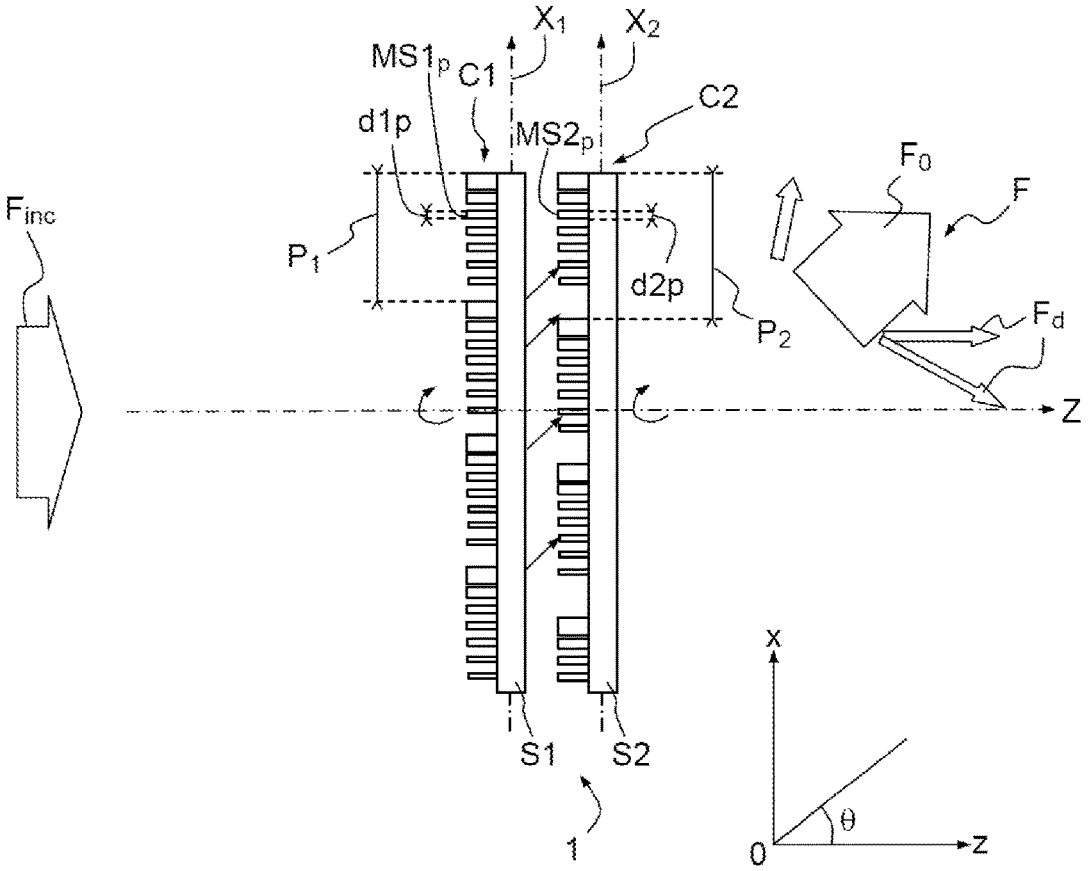
FIG. 3 illustrates an exemplary deflection system according to the invention.

FIG. 3 represents an exemplary deflection system 1 for an incident microwave frequency beam Finc according to the invention. The incident beam Finc exhibits a wavelength contained in a band of wavelengths corresponding to the microwave frequencies, typically a wavelength of between 1 mm and 1 m.

The deflection system 1 comprises at least two diffractive dielectric components, a first diffractive dielectric component C1 and a second diffractive dielectric component C2. The components C1 and C2 are suitable for each, and independently, performing a rotation about an axis Z.

The deflection system 1 is suitable for generating a microwave frequency beam F from the incident microwave frequency beam Finc. The components C1 and C2 are diffracting gratings suitable for diffracting a beam. The component C1 illuminated by the incident beam Finc diffracts a first beam, this beam then itself being diffracted by the second component C2, generating the beam F of the system 1.

The beam F is oriented according to an angle that is a function of the angular positioning between the first diffractive component C1 and the second diffractive component C2 according to the principle of the diasporameter.

The first diffractive dielectric component C1 exhibits a first periodic structure of first period P1 along an axis X1. The first structure comprises a plurality of first primary microstructures MS1*p* formed on a first substrate S1 exhibiting a first substrate refractive index n1*s*.

The first structures MS1*p* exhibit at least one first primary size d1*p* smaller than the ratio between a target wavelength λ0 and the index of the substrate n1*s*. The target wavelength λ0 is chosen from the band of wavelengths corresponding to the microwave frequency waves, i.e. a wavelength of typically between 1 mm and 1 m.

$$d1p<\lambda 0/n1s$$

The structures MS1*p* are so-called subwavelength structures or sub-λ, because of their small size at the wavelength of the incident beam on the component.

The microstructures sub-λ form an artificial material exhibiting a first effective index n1eff. The arrangement of the microstructures MS1*p* in a period is such that they form an artificial material exhibiting a first variation of the effective index n1eff.

The characteristics of the second component C2 are of the same nature, but are not necessarily equal.

The second component C2 exhibits a second periodic structure of second period P2 along an axis X2. The second structure comprises a plurality of second primary microstructures MS2*p* formed in a second substrate S2 exhibiting a second substrate refractive index n2*s*. The microstructures MS2*p* are also structures of sub-λ type.

$$d2p<\lambda 0/n2s$$

The arrangement of the microstructures MS2*p* in a period P2 is such that they form an artificial material exhibiting a second variation of the effective index n2eff.

Certain major advantages of the deflection system 1 according to the invention are those of an electronic scanning antenna, that is to say a compact system maintaining a same volume, seen from outside, regardless of the orientation of the radiated beam, but with the advantages of a mechanical system, that is to say a lesser electrical consumption since the control does not need to be maintained when the antenna remains inert, a simpler system (without phase shifter or wire or amplifier) and with no cooling management.

The small dimensions of the primary microstructures MS1*p* and MS2*p*, called subwavelength microstructures or sub-λ microstructures make it possible to eliminate the shadowing effect obtained by a diasporameter produced with blazed gratings.

Furthermore, the deflection system 1 according to the invention for the incident beam Finc has little bulk and is lightweight, and the distribution of the energy of the diffracted beam F in space is determined by the value of the periods P1 and P2 and by the variation of the effective indices n1eff and n2eff within the periods P1 and P2. This distribution can thus be optimized.

The effective index n1eff varies according to the period P1 as a function of an abscissa x n1eff(x), between a first minimum value n1min and a first maximum value n1max, with n1min<n1max. Since the grating is in contact with the air, n1min is greater than or equal to 1.

The effective index n2eff varies according to the period P2 as a function of an abscissa x n2eff(x) between a second minimum value n2min and a second maximum value n2max, with n2min<n2max. Since the grating is in contact with the air, n2min is greater than or equal to 1.

According to a preferred variant of the system according to the invention, the sub-λ microstructures MS1*p* and MS2*p* are formed in the body of their respective substrates S1 and S2. The microstructures are thus easier to produce, the production technique being, for example, mechanical or laser machining of the substrate, molding, fritting or 3D printing. According to this variant, the values of n1max and of n2max cannot exceed the index value of the corresponding substrate, thus:

$$1<n1\min<n1\max<n1s \text{ and } 1<n2\min<n2\max<n2s$$

As illustrated in FIG. 3, the beam F generated by the system 1 comprises a plurality of beams:

a main beam F0 corresponding to the deflected beam for which the energy is to be maximized, a plurality of beams Fd diffracted in directions other than the direction of the main beam, which are "spurious" beams for which the energy is to be minimized.

The spurious diffracted beams can be indexed by an index i corresponding to the order to which they correspond, and called Fd(i) with i≠1. The set of these spurious beams is called, globally, Fd, thus:

$$F=F0+Fd$$

The main beam F0 concentrates a significant portion of the diffracted energy and corresponds to the beam deflected by the system 1. Thus, the deflection system 1 is suitable for generating a beam deflected in a plurality of orientations because of the rotations of the components C1 and C2, rendering the system configurable in terms of deflection angle.

The spurious diffracted beams Fd comprise, for example, the diffracted beam in the order −1 (Fd(−1)), the diffracted beam in the order 0 (Fd(0)), the diffracted beams in the higher orders Fd(−2), Fd(−3), etc.

As will be described later, the sub-λ structures allow for a great flexibility in the design of the variation of the effective index in a period. This flexibility makes it possible to optimize the form and the arrangement of the sub-λ structures MS1*p* and MS2*p* to obtain a variation of the effective indices n1eff and n2eff respectively over a period P1 and P2 such that the energy radiated in the main deflected beam F0 of intensity 10 is favored, and the energy diffracted in the spurious diffracted beams Fd(i) of intensity Id(i) is minimized.

More specifically, the variation of the effective index induces a phase variation on the incident beam on the component. The periodic structure of the effective index variation (period P) induces a periodic phase variation structure.

Advantageously, the phase variation induced by variation of effective index over a period P is substantially equal to 2π (to within 10%) between one end of the period and the other end of this same period.

Over a period, the use of sub-λ microstructures thus makes it possible to produce a phase law optimized for the energy radiated in the main deflected beam to be favored, and the energy diffracted in the spurious diffracted beams to be minimized. The optimization is performed on the complete system comprising at least two diffractive dielectric components. Thus, the period and the phase law over a period is not necessarily identical for the first component C1 and the second component C2.

Advantageously, the phase law, and therefore the effective index variation, over a period, is virtually monotonic. According to an embodiment described later, the phase law, and therefore the effective index variation, over a period is constant by subintervals, that is to say variable by steps.

The primary microstructures are arranged according to different variants. These variants are applicable to the first diffractive dielectric component C1 and to the second diffractive dielectric component C2 independently.

Generally, the primary microstructures MSp are arranged according to a periodicity P along an axis X.

The microstructures are formed in a dielectric material either protruding, in pillar form, or hollowed out, in hole form. A combination of holes and pillars is also possible.

In the case where the microstructures are formed in the body of a substrate S, the pillars and/or the holes are produced directly in the substrate for example by the production methods described previously.

The microstructures are of any form, preferentially with axes of symmetry to render them independent of the polarization of the incident beam at normal incidence, which allows for a behavior of the deflection system according to the invention scarcely sensitive to the polarization. Advantageously, the microstructures according to the invention have a square, hexagonal or circular section, or a combination of different geometries.

Advantageously, as a variant, the period P of the grating (P1 and/or P2) is sampled according to a sampling period Pe (P1*e* and/or P2*e*) less than P (P1 and/or P2) dividing period P and defining sampling intervals Ii indexed by an index i. The primary microstructures (MS1*p*, MS2*p*) are arranged within each interval Ii of dimension Pe so as to correspond to a given effective index value neff(i) in said interval.

The variation of effective index neff (n1eff and/or n2eff) according to the period P is thus sampled according to a period Pe. Preferentially, the sampling period Pe is chosen to be greater than or equal to λo/10.ns.

In this case, the phase law synthesized with the microstructures makes it possible to produce a phase law that is discontinuous by levels or jumps, each jump corresponding to a given phase value and therefore to a given effective index value.

Figure 4A:
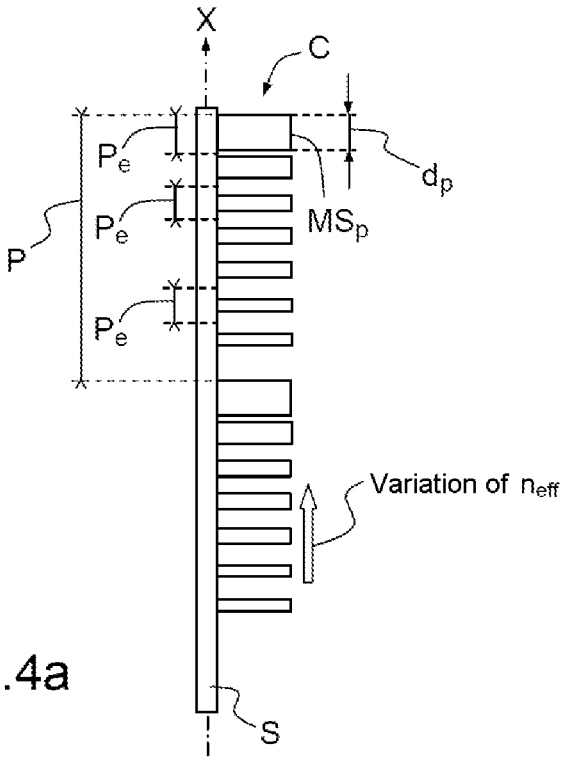
FIGS. 4*a* and 4*b* describe an exemplary diffractive component according to the invention.
Figure 4B:
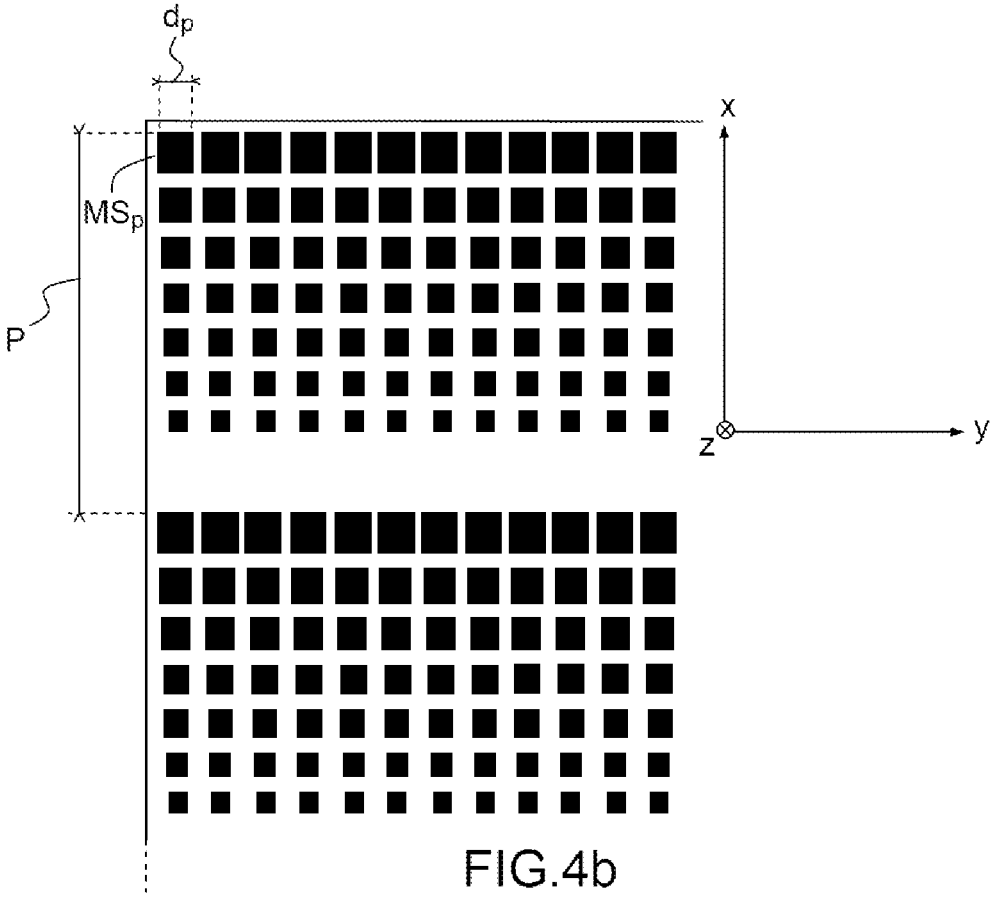

By way of illustration of this variant, FIGS. 4*a* and 4*b* describe a diffractive dielectric grating C according to the invention that can correspond to C1 or to C2, consisting of primary microstructures MSp in pillar form distributed periodically according to a period Pe, their primary size dp being variable along the period P. It is the variation of their size which allows for the variation of the effective index neff according to the period P. FIG. 4*a* corresponds to a profile view, FIG. 4*b* to a plan view of the component C.

In the nonlimiting example of FIGS. 4 and 4*b*, at most one primary microstructure MSp (MS1*p* and/or MS2*p*) is arranged per sampling interval Ii. In the example, the dimension of the microstructure dp (dp1 and/or dp2) varies from one interval to another. The interval without microstructure is equivalent to an effective index equal to the refractive index of air.

Figure 5:
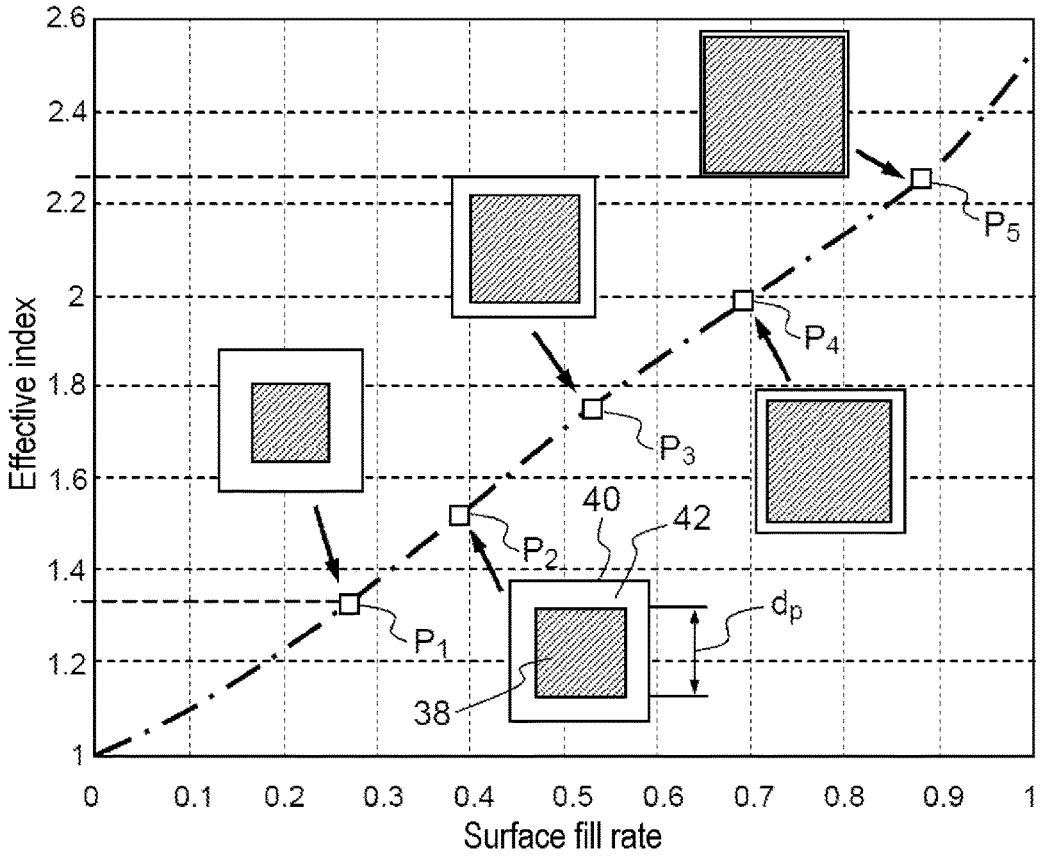
FIG. 5 illustrates the concept of effective index for the example described in FIGS. 4*a* and 4*b*.

FIG. 5 illustrates the concept of effective index for the variant described in FIGS. 4*a* and 4*b* and gives an example of a calibration curve to determine the dimension of the pillar corresponding to a chosen effective index value. FIG. 5 represents the variation of the effective index neff as a function of the surface fill rate of the microstructures, which varies between 0 and 1. The graph corresponds to pillars of period Pe=2.4 mm, produced in a dielectric substrate material S of substrate index ns=2.54. The target wavelength λ0 is 7.14 mm, corresponding to a frequency of 42 GHz. The period Pe is, in this example, equal to 0.336x λ0.

The points P1 to P5 represented in FIG. 5 correspond on the x axis to five microstructure size values, and therefore to five different surface fill rate values. The surface fill rate is represented schematically by a plan view of each square-section pillar 38 centered per unit of surface area 40. The area 38 represents the dielectric material forming the pillar, the area 42 corresponds to the air, that is to say the area left empty around the pillars. On the y axis, the value of the effective index corresponding to each case can be read.

By way of example:

for the point P1, the side D0 of the square section of each pillar is 0.179×λ0, i.e. 1.28 mm, to which corresponds an effective index of 1.34.

for the point P5, the side D0 of the square section of each pillar is 0.322×λ0, i.e. 2.3 mm, to which corresponds an effective index of 2.28.

At the limits, the absence of a pillar corresponds to an effective index equal to the index of the air 1 and a complete overlapping of the surface by the microstructures corresponds to the substrate index value 2.54.

It can be seen in FIG. 5 that the value of the effective index is a function of the surface fill rate. Thus, by acting on the size of the microstructures, the microstructures that have a plurality of sizes variable along the period P, an ordinary effective index profile is generated lying between 1 and the substrate index value ns, sampled by the number of pillars over the period. In the example of FIGS. 4*a* and 4*b*, there are 7 pillars per period, plus a gap, 7 effective index values can be obtained, in addition to the limit value 1. The same type of behavior is obtained with holes.

Figure 6A:
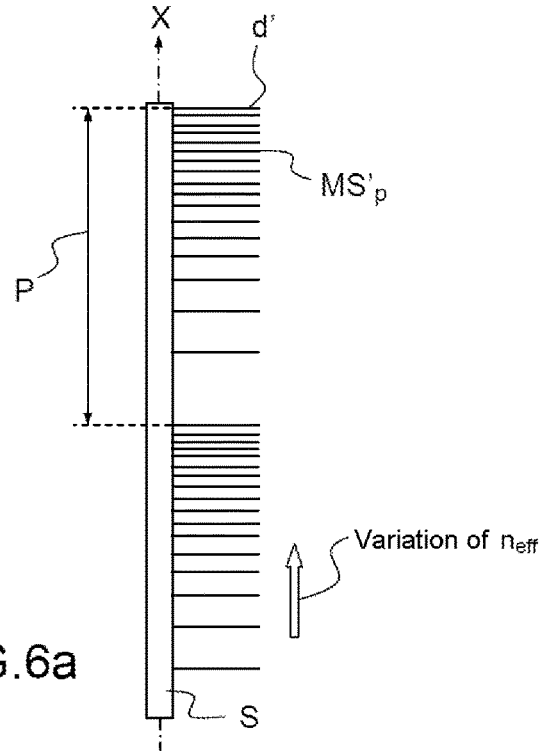
FIGS. 6*a* and 6*b* describe another exemplary diffractive component according to the invention.
Figure 6B:
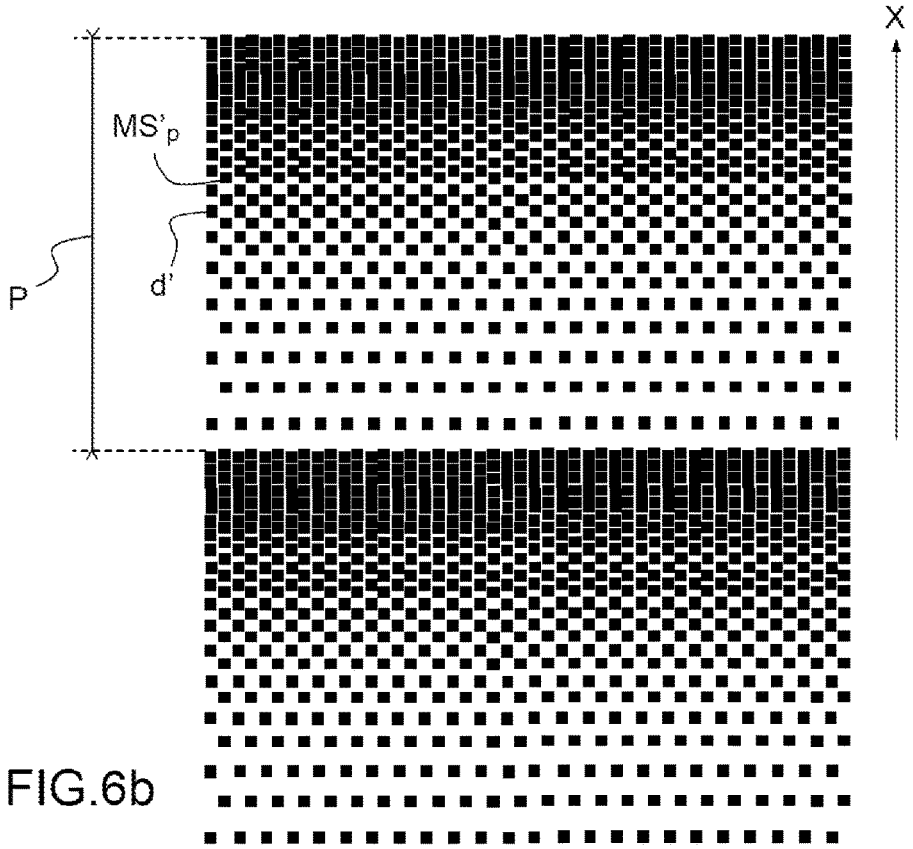

According to a second variant described in FIGS. 6*a* and 6*b*, a diffractive dielectric grating C is made up of pillar microstructures MSp' of constant size d', and of density per unit of surface area that is variable along the period P. It is the variation of their density which allows for the variation of the effective index neff according to the period P. The method for producing the component is thus facilitated. FIG. 6*a* corresponds to a profile view, FIG. 6*b* to a front view of the component C.

Figure 7:
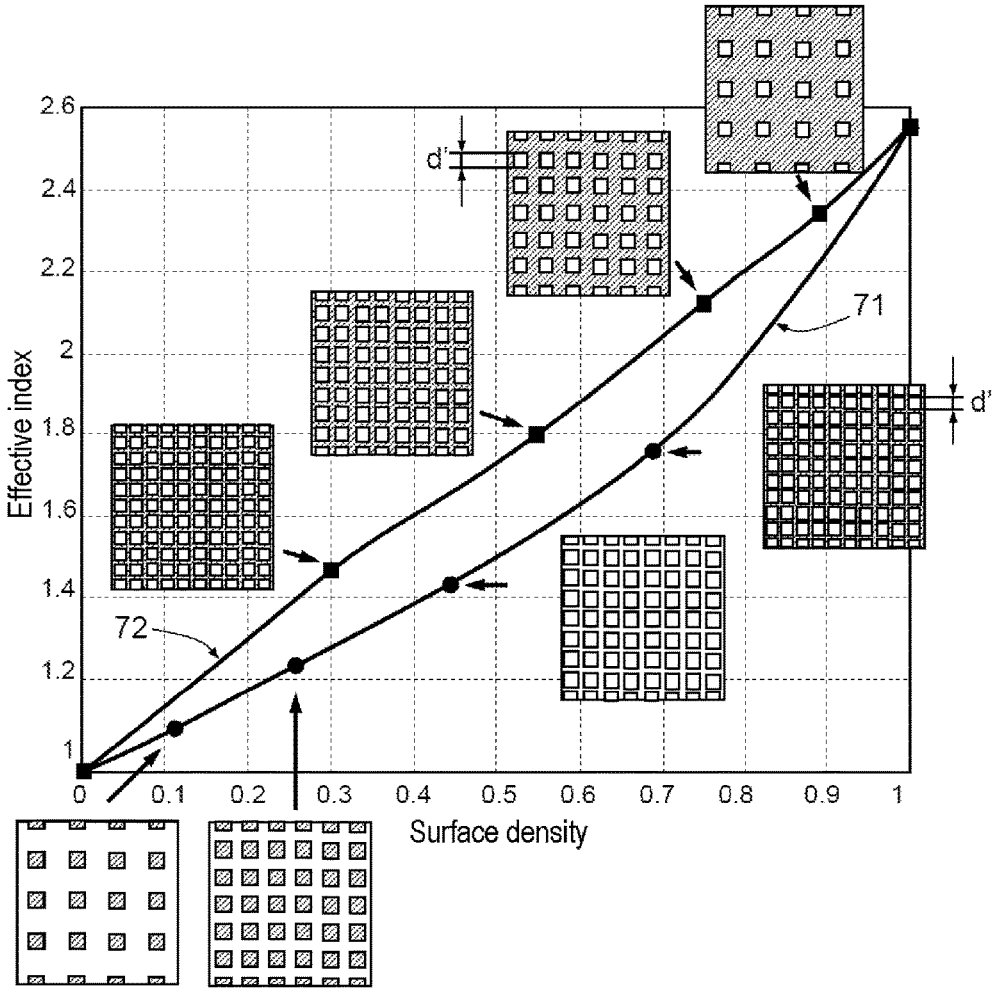
FIG. 7 illustrates the concept of effective index for the example described in FIGS. 6*a* and 6*b*.

FIG. 7 illustrates the concept of effective index for the variant described in FIGS. 6*a* and 6*b* and gives an example of a calibration curve to determine the density per unit of surface area of pillars or of holes corresponding to a chosen effective index value. FIG. 7 represents the variation of the effective index neff as a function of the surface fill rate of the microstructures, which varies between 0 and 1.

The graph 71 corresponds to pillars of dimension d'=0.2 mm, produced in a dielectric substrate material S of substrate index ns=2.54. The graph 72 corresponds to holes of the same dimension. The white areas correspond to the air, the shaded areas to the presence of material. The different surface densities are described schematically at different points on the curves.

It can be seen in FIG. 7 that the value of the effective index is a function of the surface fill rate.

In order to obtain a component that is easy to produce, the overall aim is to minimize the height of the microstructures. In a variant, the two geometries are combined, namely pillars and holes, in order to reduce the height of the microstructures.

Advantageously, in one embodiment, the component C (C1 and/or C2) further comprises at least one plurality of the secondary microstructures MSs (MS1*s* and/or MS2*s*) of secondary size ds (d1*s* and/or d2*s*) smaller than the size D0 (d1*p* and/or d2*p*) of the corresponding primary microstructures MSp. The secondary microstructures are arranged as a second layer on the first layer of the primary structures MSp (MS1*p* and/or MS2*p*).

The secondary microstructures are preferentially pillars or holes or a combination of the two, and preferentially have forms such as squares, hexagons or circles.

The use of secondary microstructures makes it possible to more finely adjust the desired effective index value so as to reduce the energy diffracted by the system 1 in the spurious orders other than that of the main beam and produce an impedance matching layer (antiglare layer).

Figure 8A:
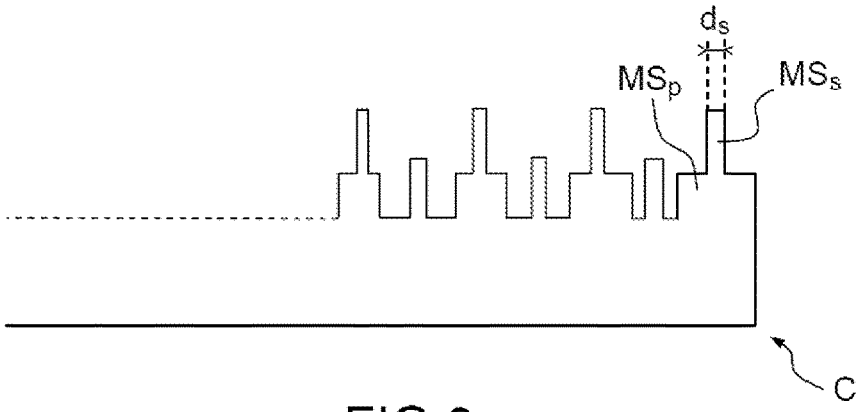
FIGS. 8*a*-8*c* describe a number of variants of the embodiment of a diffractive component according to the invention comprising secondary microstructures.
Figure 8B:
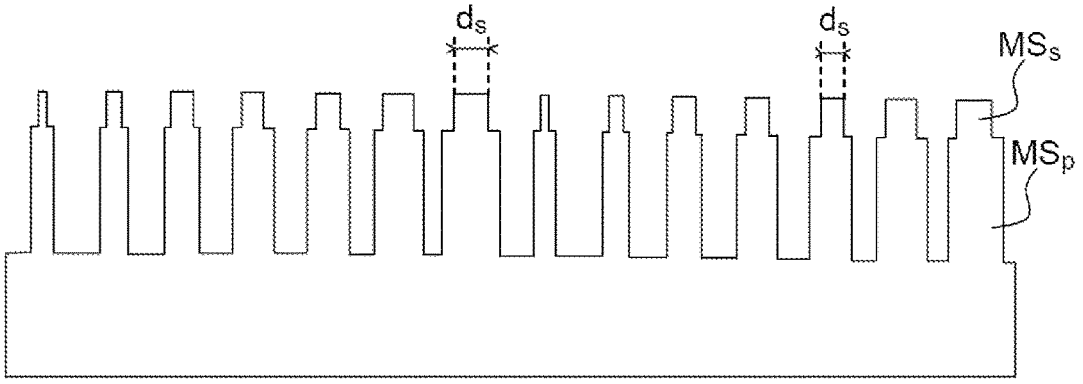
Figure 8C:
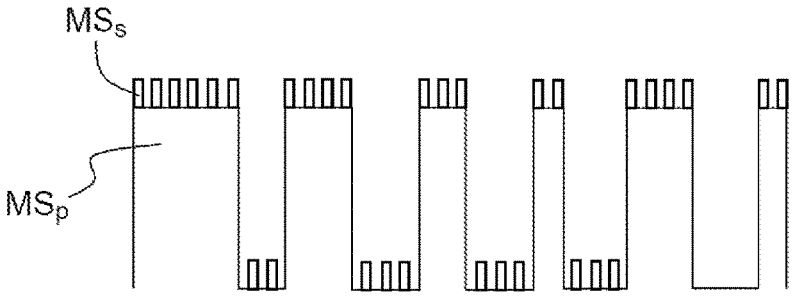

FIGS. 8*a*-8*c* illustrate a number of variants of the embodiment comprising secondary microstructures. The component C (C1 or C2) comprises primary microstructures MSp of variable size in pillar form according to a first layer, and secondary microstructures MSs also in pillar form arranged protruding as a second layer.

According to these variants, the secondary pillars of size ds, given (8*a* and 8*c*) or variable (8*b*), are situated on the primary pillars (8*a*, 8*b*, 8*c*) and/or between the latter (8*a*).

In these variants, the secondary microstructures are arranged periodically according to a period less than (8*a* and 8*c*) or equal to (8*b*) the period P of the primary microstructures.

Figure 9A:
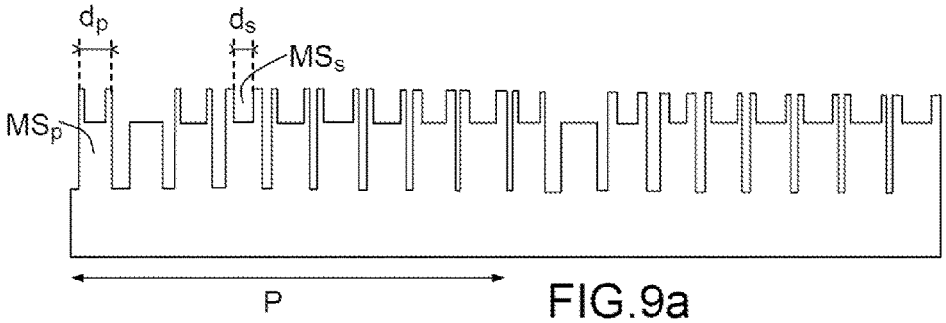
FIGS. 9*a* and 9*b* describe another variant of the embodiment comprising secondary microstructures.
Figure 9B:
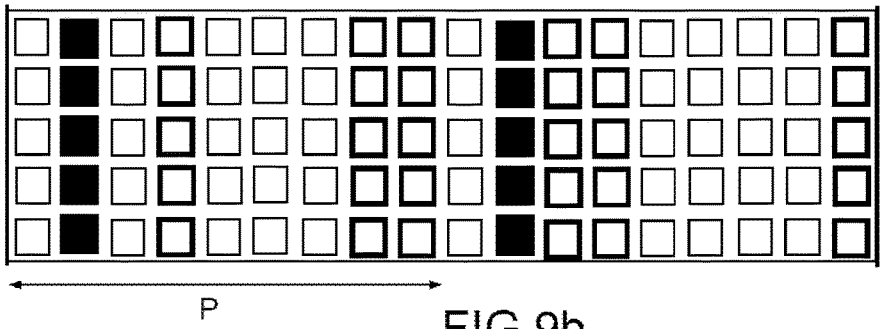

FIGS. 9*a* and 9*b* illustrate another variant of the embodiment comprising secondary microstructures. FIG. 9*a* is the profile view and FIG. 9*b* is the plan view of the component C (C1 and/or C2).

The component C (C1 and/or C2) comprises primary microstructures MSp (MS1*p* and/or MS2*p*) of variable size dp (d1*p* and/or d2*p*) along the period P (P1 and/or P2), as described in FIGS. 4*a* and 4*b*, in square pillar form. The period P is sampled according to a sampling period Pe (P1*e* and/or P2*e*), and there is at most one primary structure per interval Ii.

The component C (C1 and/or C2) also comprises secondary microstructures MSs (MS1*s* and/or MS2*s*) in square hole form, of variable size ds (d1*s* and/or d2*s*).

According to a variant illustrated in FIGS. 9*a* and 9*b*, at most one secondary microstructure is arranged per sampling interval Ii. In the second example illustrated in FIGS. 9*a* and 9*b*, a primary microstructure in square pillar form is holed by a secondary microstructure in square-section hole form.

Advantageously, the secondary microstructures are centered on the corresponding primary microstructure arranged in the same sampling interval.

Figure 10:
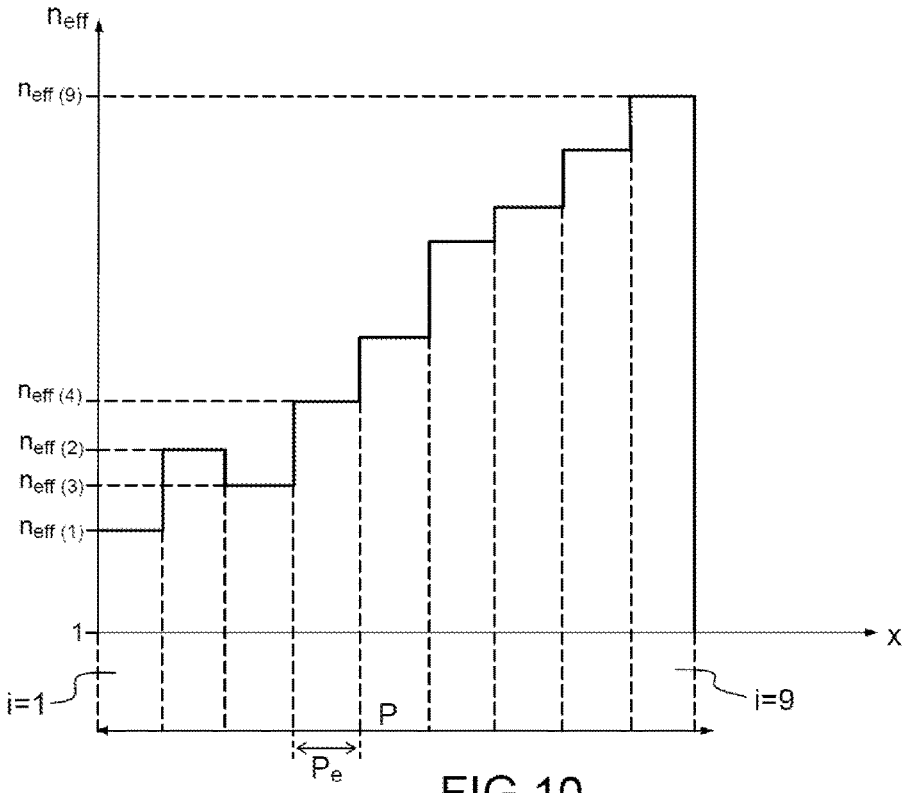
FIG. 10 schematically illustrates the variation of effective index obtained with the microstructures described in FIGS. 9*a* and 9*b*.

FIG. 10 schematically illustrates the variation of effective index neff(i) obtained with the microstructures described in FIGS. 9*a* and 9*b*. The period P is divided into 9 intervals (i=1 to 9) according to a sampling period Pe, and a given effective index value neff(i) is generated for each interval.

Advantageously, to simplify the structure, the plane X1Y1 of the component C1 and/or the plane X2Y2 of the component C2 is/are at right angles to the rotation axis Z.

Advantageously, the angle of diffraction of the main order of the deflection system 1 is greater than or equal to 60° as an absolute value, in order to obtain a total deflection amplitude contained within a cone of at least 120°.

Typically, each component C1 and C2 has an angle of diffraction of the main beam greater than or equal to 25°, which leads to periods P1 and P2 of respectively C1 and C2 less than or equal to 24 mm for a target wavelength λ0=10 mm.

According to a variant, the first period P1 and the second period P2 are identical, P1=P2. The calculations are then simplified.

According to another variant, the periods P1 and P2 have distinct values, with P1<P2, for a finer optimization of the deflection system 1. When the component P1 is illuminated by the incident beam at normal incidence, the component C2 is illuminated by the beam diffracted by the component C1, according to an angle of incidence greater than 0°. Thus, in order to optimize the system, the period P2 of the component C2 is greater than the period P1 of the component C1.

Advantageously, the incident beam Finc is a collimated beam for a better operation of the deflection system according to the invention.

Advantageously, the incident beam Finc illuminates the first component C1 at normal incidence for a better operation of the deflection system according to the invention.

There now follows a description of exemplary numerical simulations of the performance levels obtained by deflection systems according to the invention, and in comparison to the performance levels obtained by a deflection system according to the prior art using two blazed gratings.

Figure 11:
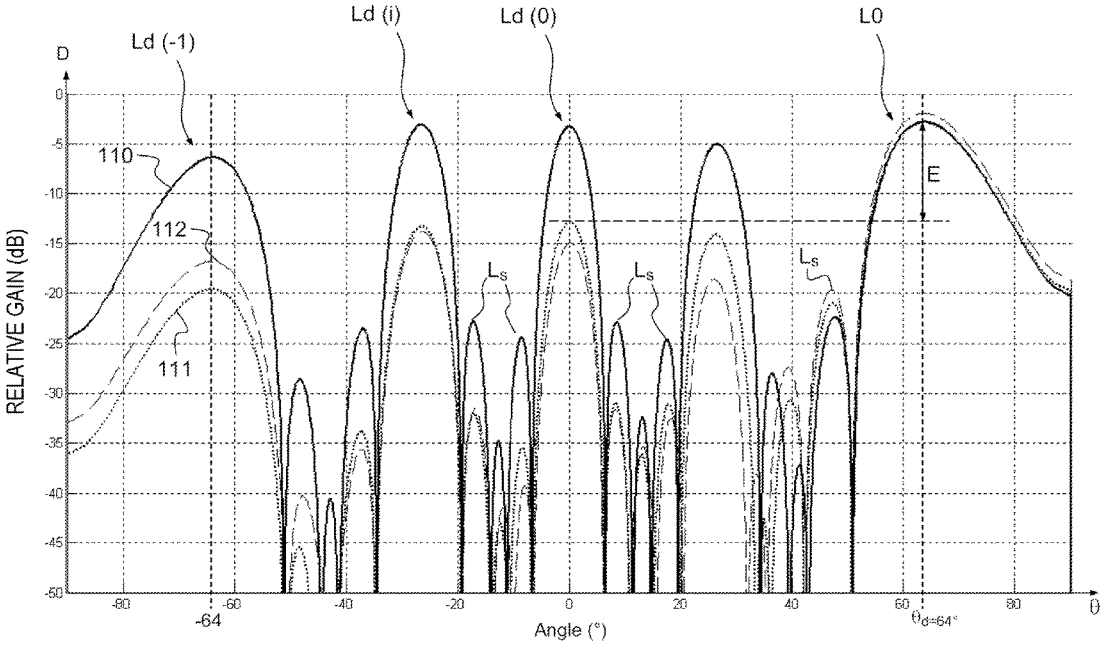
FIG. 11 illustrates the comparative behavior of three deflection systems compared by numerical simulation.
Figure 12A:
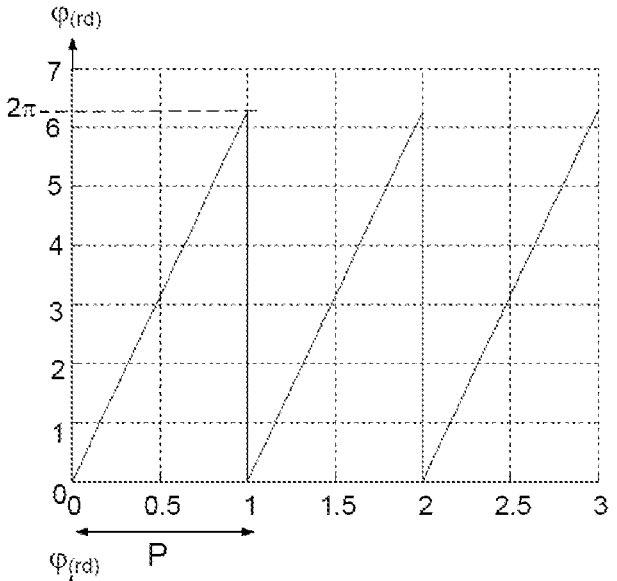
FIGS. 12*a*-12*c* describe the phase induced by the three deflection systems illustrated in FIG. 11.

FIG. 11 illustrates the comparative behavior, by numerical simulation, of three deflection systems by plotting the relative gain of the antenna misaligned to its maximum deviation as a function of the angle. The three deflection systems, exhibiting an aiming angle at θd=64°, are described hereinbelow:

a so-called "blazed" deflection system made up of two gratings of conventional identical blazed type. The phase ϕ induced by a blazed grating is illustrated in FIG. 12*a*. The index of the material is 1.59 and the height of the blazed grating is 16.9 mm to induce a phase variation of 27 over a period P.

a so-called "pseudo-blazed" deflection system according to the invention consisting of two identical components C1 and C2 as described schematically in FIGS. 4*a* and 4*b*, with 9 sampling intervals.

Figure 12B:
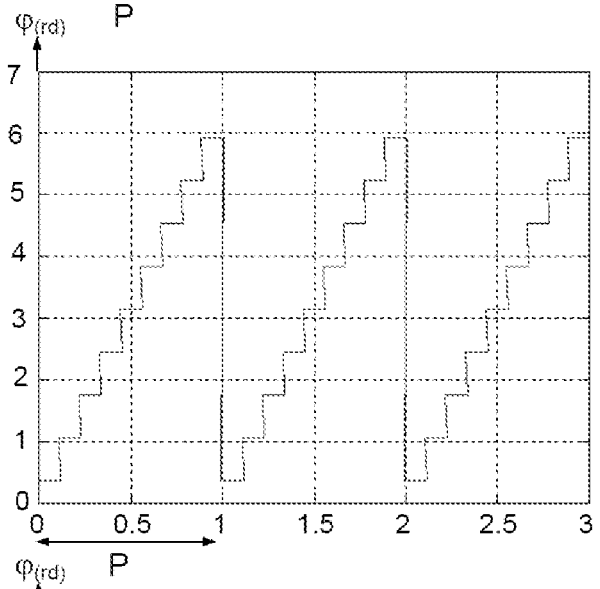

The phase ϕ induced by a "pseudo-blazed" grating (C1 or C2) according to the invention is illustrated in FIG. 12*b*. The index of the material is 3.4 and the height of the microstructures is 4.2 mm.

The effective index values neff(i) and the values of the height of the microstructure are calculated to induce a phase variation close to 2π over a period P according to a linear law per step.

The sides of the pillars vary between approximately 0.8 mm and 2.5 mm in an increasing manner, and the sampling period Pe is equal to approximately 2.5 mm.

a deflection system according to the invention called "optimized 1" consisting of two identical components C1 and C2 as described schematically in FIGS. 9*a* and 9*b*, also with 9 sampling intervals.

Figure 12C:
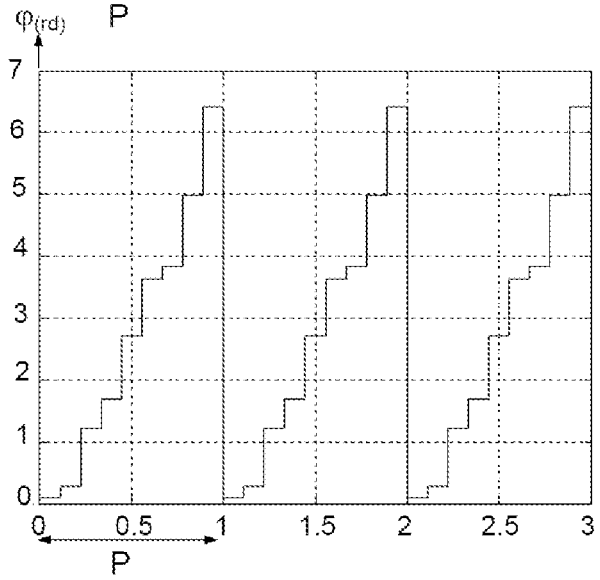

The phase ϕ induced by an "optimized 1" grating (C1 or C2) according to the invention is illustrated in FIG. 12*c*. The index of the material is 3.4 and the height of the component is approximately 10 mm.

The effective index values neff(i) are calculated to induce a phase variation close to 2π over a period P according to a nonlinear law per step.

The sides of the pillars vary between approximately 1.8 mm and 2.5 mm nonlinearly, and the sampling period Pe is equal to approximately 2.5 mm. These pillars are holed with square holes of side varying between 1.4 mm and 2.4 mm. The arrangement of the structures is optimized to minimize the energy diffracted in the spurious diffraction orders.

The planes of the substrates of the components are at right angles to the axis Z.

The axes X1 and X2 are parallel, there is no angular deviation between the two components C1 and C2.

For these simulations, the incident beam Finc illuminates the deflection system with an angle equal to 0° by taking the axis Z as reference axis (normal incidence) and exhibits a wavelength λ0=10 mm. It is also assumed that the ohmic losses (characterized by a loss tangent) in the material are zero.

The periods of the gratings are all identical, equal to P=P1=P2=22.3 mm, such that the main deflected beam from the deflection system has a diffraction angle θp equal to approximately 64°.

The behavior of the deflection systems described above is simulated in FIG. 11 by calculating the angular distribution of the energy I(θ) expressed in dB, called relative gain D, according to the formula:

$$D(\theta)=10\log[I(\theta)/Ii]$$

Ii is the intensity of the incident beam Finc.

The figure gives the relative gain of the antenna in a configuration of maximum deflection as a function of the angle θ, which corresponds to the angle of observation in the plane Oxz relative to the axis Z (rotation axis of the components).

A curve D(θ) shows:

the main lobe L0 associated with the energy deflected in the vicinity of the angle θd=64° corresponding to the main order (main deflected beam F0).

a plurality of lobes associated with the energy diffracted in the vicinity of the diffraction angles corresponding to the other orders (spurious diffracted beams Fd(i)), called grating lobes Ld(i).

secondary lobes generally called Ls arranged on either side of the main lobe and of the grating lobes, and attenuated relative to the lobes around which they are arranged.

The curve 110 corresponds to D(θ) for the deflector consisting of conventional blazed gratings.

The curve 111 corresponds to D(θ) for the deflector according to the "pseudo-blazed" invention.

The curve 112 corresponds to D(θ) for the deflector according to the "optimized 1" invention.

The efficiency D0 is defined as the value in dB of the relative gain of the main lobe L0, with the minimum attenuation.

The level of a spurious lobe Dd(i) is defined as the value in dB of the relative gain of the grating lobe Ld(i), with the minimum attenuation.

More particularly, Dd(0) corresponds to the rejection in the mechanical main axis.

A level deviation corresponding to a spurious order of index i is also defined by the difference between the absolute value of the relative gain Dd(i) and the absolute value of the relative gain of the main lobe D0:

$$E(i)=|Dd(i)|-|D0|$$

This relative deviation is expressed in dBc (decibel relative to carrier) and corresponds to the level in dB relative to the main lobe.

It can be seen in FIG. 11 that the blazed deflector exhibits a main relative gain of −3 dB, the "pseudo-blazed" deflector exhibits a main relative gain of −3 dB and the "optimized 1" deflector exhibits a main relative gain of −2 dB.

The blazed grating lobes are significant and are either not at all or scarcely more attenuated than the main lobe. These lobes are a nuisance in certain applications and must be minimized for a good operation of the deflector. Generally, the aim is to attenuate all the grating lobes.

The deflection systems according to the invention, "pseudo-blazed" and "optimized 1", exhibit much more attenuated grating lobes. Table 1 summarizes the various relative gain deviations.

TABLE 1

| | Efficiency D0 (in dB) | Rejection of the main axis Dd(0) (in dB) | Levels of the other grating lobes Dd(i, i ≠ 0) (in dB) | Minimum deviation (in dBc) |
|---|---|---|---|---|
| Conventional blazed grating | −3 | −3 | −3, −5; −6.5 | 0 |
| Pseudo-blazed grating | −3 | −13.5 | −13.5; −14; −19.5 | 10 |
| Optimized 1 | −2 | −15 | −14; −17, −18.5 | 12 |

Thus, the deflectors according to the invention make it possible to obtain relative gain deviations that are very significantly increased relative to the prior art of the blazed deflector.

The theoretical deviations obtained by numerical simulation are greater than or equal to 10 dB.

Thus, the optimization of the variation of the effective indices neff according to the period P makes it possible to increase the value of the deviations between the energy radiated in the main order (main relative gain) and the energy radiated in the spurious diffraction orders (spurious relative gain).

More generally, the simulation of the behavior of the system according to the invention comprising sub-λ microstructures makes it possible to identify variations n1eff(x) and n2eff(x) culminating in performance levels of the deflection system according to the invention very superior to those of a deflection system obtained with conventional blazed-type gratings.

Figure 13:
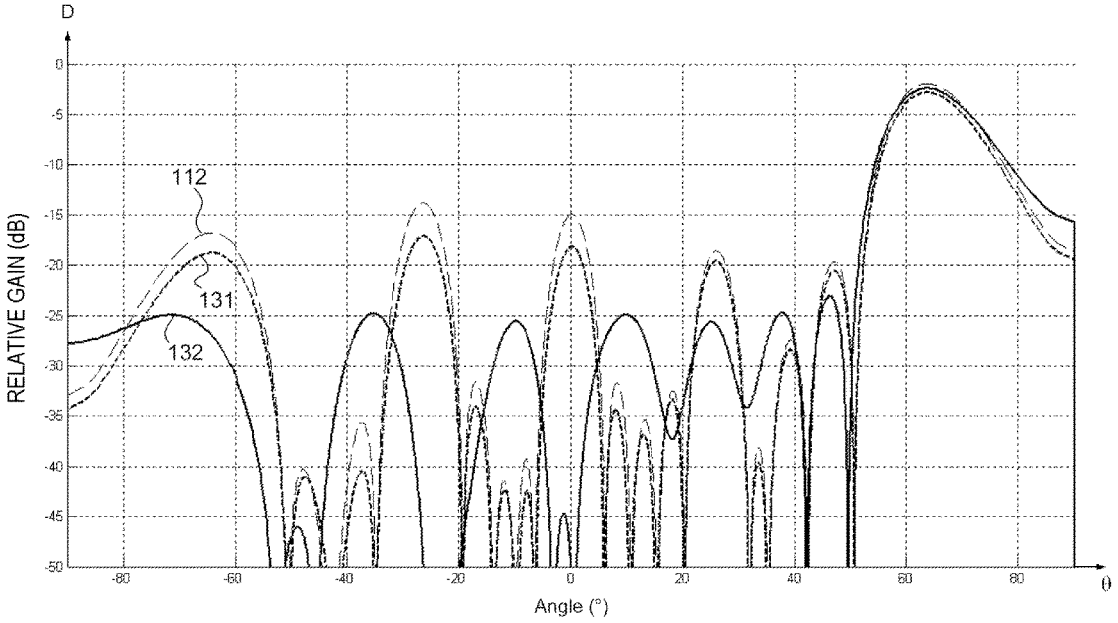
FIG. 13 illustrates the comparative behavior of three deflection systems according to the invention.

FIG. 13 describes, on the curve 131, the relative gain D(θ) of an exemplary deflection system 1 according to the "optimized 2" invention with two diffractive components C1 and C2 exhibiting the same period (P1=P2), and different microstructures for C1 and C2 inducing a different variation of n1eff and n2eff.

The curve 132 describes the relative gain D(θ) of an exemplary "optimized 3" deflection system 1 according to the invention with two diffractive components C1 and C2 exhibiting two different periods P1 and P2 and different microstructures for C1 and C2 inducing a different variation of n1eff and n2eff. The curve 112 corresponds to the "optimized 1" deflection system as described previously.

It can be seen that the deviations E are greater than 14 dB for the "optimized 2" system and greater than 20 dB for the "optimized 3" system.

Thus, advantageously, the deflection system of the invention generates a microwave frequency beam F comprising a deflected main beam F0, of main lobe L0 and of relative gain of the main lobe D0, and a plurality of spurious diffracted beams Fd, of spurious lobes Ld and of relative gains of the spurious lobes Dd, in which the first and second variations respectively of the first and second effective indices n1eff, n2eff are adapted to synthesize a first and a second phase law (each being advantageously monotonic or quasi-monotonic) making it possible to control the radiation pattern of the antenna, and more particularly to maximize the level of the main lobe L0 and minimize the levels of the spurious lobes Ld.

Advantageously, each of the deviations between the relative gain of the main lobe D0 and one of the relative gains of the spurious lobes Dd is greater than or equal to 10 dB when the incident microwave frequency beam Finc exhibits a wavelength equal to the target wavelength λ0.

Advantageously, each of the deviations between the relative gain of the main lobe D0 and one of the relative gains of the spurious lobes Dd is greater than or equal to 15 dB when the incident microwave frequency beam Finc exhibits a wavelength equal to the target wavelength λ0.

Advantageously, the deviations between the relative gain of the main lobe and the relative gains of the secondary lobes are kept greater than 10 dB for a bandwidth centered on the frequency f0 corresponding to the target wavelength λ0, the limits corresponding to the frequencies associated with a wavelength equal to the target wavelength λ0+/−5%.

For example, for λ0 equal to 10 mm, f0 is equal to 30 GHz, and the bandwidth is equal to [28.5 GHz; 31.5 GHz].

The table below gives the levels of the different lobes of the deflection system according to the "optimized 3" invention for three different values of the wavelength of the incident beam Finc.

| | Efficiency D0 (in dB) | Rejection of the main axis Dd(0) (in dB) | Level of the other grating lobes Dd (i, i ≠ 0) (in dB) | Minimum deviation (in dB) |
|---|---|---|---|---|
| 10 mm | −3 | −45 | −25, −25, −25.5; −25; −25.5 | 22 |
| 10.5 mm | −3 | −48 | −24; −23; −23.5; −25; −25 | 20 |
| 9.5 mm | −2.5 | −45 | −22.5; −22.5; −26; −24, −24 | 20 |

In this example, for a wavelength variation of +/−5%, the minimum deviations are kept greater than 20 dB.

Generally, one of the advantages of the deflection system according to the invention is the production of the diffractive components C1 and C2, which can be done easily and inexpensively because of their dimensioning. In particular, production by molding, and therefore in a single step, is possible. 3D printing is also one possible production technique.

Based on the frequency range and the size of the antennas, there are different types of technology for producing the components C1 and C2 according to the materials.

Various production techniques are possible, such as, for example:

mechanical machining
molding
fritting
ceramic or printed circuit stacking techniques
laser machining
3D printing or prototyping.

These techniques are compatible with the materials used in the microwave frequency range.

Another aspect of the invention relates to an antenna comprising a deflection system according to the invention.

According to one embodiment, the antenna comprises a microwave frequency feed S arranged substantially at the focus of a dielectric lens L so as to generate a collimated beam, and a deflection system according to the invention.

Figure 14:
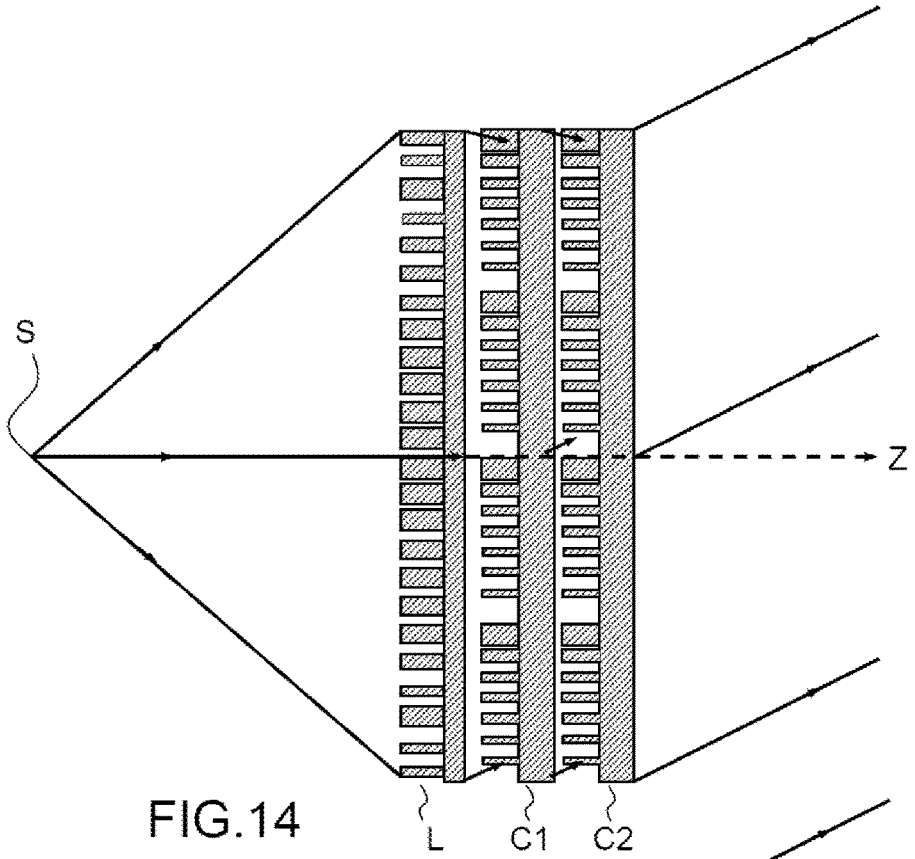
FIG. 14 illustrates a variant antenna comprising a deflection system according to the invention.

Advantageously, the dielectric lens L is also produced from sub-λ microstructures, as described in FIG. 14.

Figure 15:
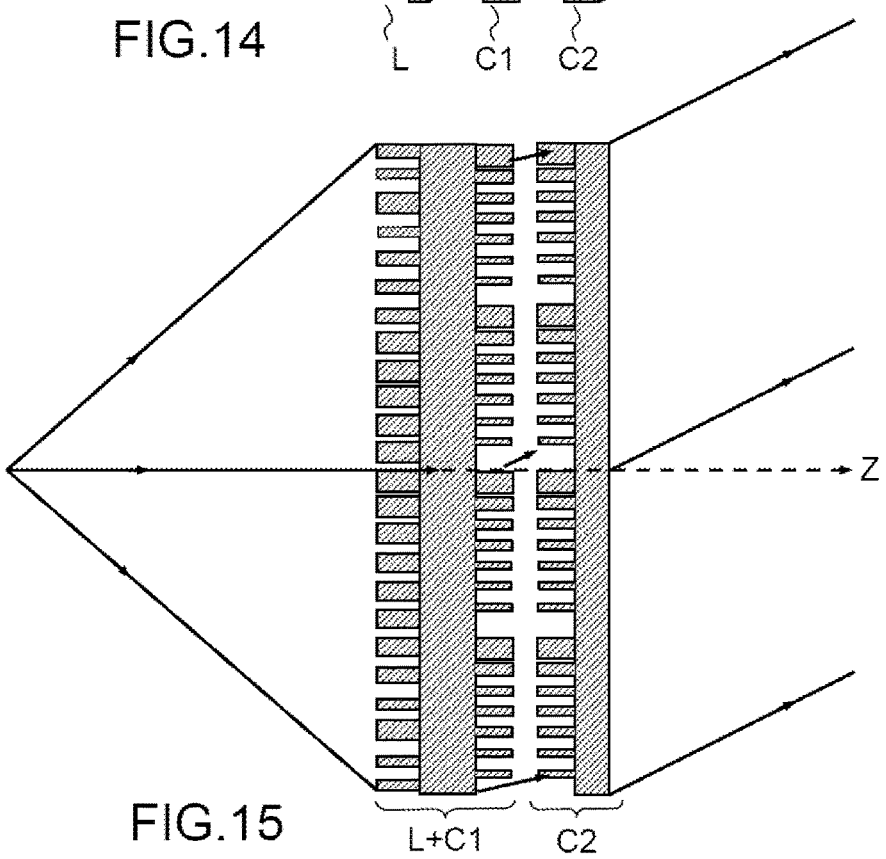
FIG. 15 describes another variant antenna comprising a deflection system according to the invention.

Advantageously, the sub-λ dielectric lens is produced on the face of the first component C1 opposite the microwave frequency feed, the function of grating type for the deflector according to the invention being produced on the other face as illustrated in FIG. 15.

According to another embodiment, the antenna comprises a microwave frequency waveguide suitable for generating a collimated beam, and a deflection system according to the invention.

The invention claimed is:

1. A configurable deflection system for an incident microwave frequency beam exhibiting a wavelength contained in a band of wavelengths corresponding to the microwave frequencies, comprising:

a first and a second diffractive dielectric component suitable for each performing a rotation about a rotation axis Z, said deflection system being suitable for generating a microwave frequency beam by diffraction of said incident microwave frequency beam on said first and second components, said microwave frequency beam being oriented according to an angle that is a function of the angular positioning between said first and said second diffractive components, said first and second components respectively exhibiting a first and second periodic structure of first and second periods according to a first and second axis, said first and second structures respectively comprising a plurality of first and second primary microstructures formed respectively on a first and a second substrate of first and second substrate refractive indices, said first and second primary microstructures respectively exhibiting at least one first and one second primary size smaller than the ratio between a target wavelength chosen from said band and respectively said first and second substrate refractive indices, said first and second primary microstructures being arranged so as to form an artificial material respectively exhibiting a first variation of a first effective refractive index and a second variation of a second effective refractive index respectively according to said first and second periods.

2. The deflection system as claimed in claim 1, in which said primary microstructures are formed in the body of said first and second substrates.

3. The deflection system as claimed in claim 1, in which said first primary microstructures are in the form of a pillar and/or a hole.

4. The deflection system as claimed in claim 1, in which said second primary microstructures are in the form of a pillar and/or a hole.

5. The deflection system as claimed in claim 1, in which said primary microstructures exhibit a hexagonal, circular or square section.

6. The deflection system as claimed in claim 1, in which at least one of said periods is sampled according to a sampling period defining sampling intervals, said primary microstructures being arranged within each interval so as to correspond to a given effective index value in said interval.

7. The deflection system as claimed in claim 1, in which said first and/or second primary microstructures respectively exhibit a plurality of first and/or second primary sizes variable along respectively the first period and/or the second period.

8. The deflection system as claimed in claim 6, in which at most one primary microstructure is arranged per sampling interval.

9. The deflection system as claimed in claim 1, in which said first and/or second primary microstructures respectively exhibit a first and/or a second given main size and a density per unit of surface area variable respectively along the first and the second periods.

10. The deflection system as claimed in claim 1, further comprising at least one plurality of secondary microstructures of secondary sizes smaller than the said primary sizes.

11. The deflection system as claimed in claim 8, in which at most one secondary microstructure is arranged per sampling interval.

12. The deflection system as claimed in claim 1, in which the first component and/or the second component is at right angles to said rotation axis Z.

13. The deflection system as claimed in claim 1, in which said first period is less than or equal to said second period.

14. The deflection system as claimed in claim 1, in which said incident beam is a collimated beam.

15. The deflection system as claimed in claim 1, in which said microwave frequency beam generated comprises a deflected main beam of relative gain of the main lobe and a plurality of spurious diffracted beams of relative gains of the spurious lobes, and in which said first and second variations respectively of said first and second effective indices are adapted so that each of the deviations between said relative gain of the main lobe and one of said relative gains of said spurious lobes is greater than or equal to 10 dB when said incident microwave frequency beam exhibits a wavelength equal to said target wavelength.

16. An antenna comprising a microwave frequency source arranged substantially at the focus of a dielectric lens so as to generate a collimated beam and a deflection system as claimed in claim 1.

17. The antenna as claimed in claim 16, in which said dielectric lens is produced from microstructures exhibiting a size smaller than the ratio between a target wavelength chosen from said band and respectively said first and second substrate refractive indices.

18. The antenna as claimed in claim 17, in which said dielectric lens is produced on a face of the first component opposite said microwave frequency source, said first structure of the first component being produced on the other face.

19. An antenna comprising a microwave frequency waveguide suitable for generating a collimated beam and a deflection system as claimed in claim 1.

* * * * *